US007305785B2

(12) United States Patent
Sharp

(10) Patent No.: US 7,305,785 B2
(45) Date of Patent: Dec. 11, 2007

(54) SHADOW BOX PAGE

(76) Inventor: David R. Sharp, 5322 Mountain Men Dr., Salt Lake City, UT (US) 84118

( * ) Notice: Subject to any disclaimer, the term of this patent is extended or adjusted under 35 U.S.C. 154(b) by 121 days.

(21) Appl. No.: 10/773,056

(22) Filed: Feb. 4, 2004

(65) Prior Publication Data

US 2005/0166440 A1 Aug. 4, 2005

(51) Int. Cl.
*G09F 3/18* (2006.01)

(52) U.S. Cl. ..... 40/771; 40/661; 402/79; 206/214

(58) Field of Classification Search ..... 40/771, 40/661; 281/15.1, 38, 51; 402/79, 80 R
See application file for complete search history.

(56) References Cited

U.S. PATENT DOCUMENTS

| | | | | | |
|---|---|---|---|---|---|
| 2,223,560 | A | * | 12/1940 | Friedlaender | 402/4 |
| 2,439,868 | A | * | 4/1948 | Segal | 206/45.2 |
| 3,353,844 | A | * | 11/1967 | Staats | 281/17 |
| 3,751,839 | A | * | 8/1973 | Mitchell | 40/775 |
| 4,023,292 | A | | 5/1977 | Shibata et al. | 40/158 R |
| 5,087,145 | A | * | 2/1992 | Cooley | 402/79 |
| 5,118,171 | A | | 6/1992 | Ortiz | 312/114 |
| 5,186,566 | A | * | 2/1993 | Cameron | 402/79 |
| 5,349,769 | A | | 9/1994 | Okola | 40/124.1 |
| 5,350,061 | A | * | 9/1994 | Gunn | 206/214 |
| 5,421,583 | A | | 6/1995 | Gluck | 273/293 |
| 5,575,503 | A | | 11/1996 | Takahashi | 281/21.1 |
| 5,754,713 | A | | 5/1998 | Deguchi et al. | 382/313 |
| D398,916 | S | | 9/1998 | Bernardi | D14/114.7 |
| 5,887,900 | A | | 3/1999 | Raymond | 281/22 |
| 5,947,522 | A | | 9/1999 | Boehm | 281/22 |
| 5,997,041 | A | | 12/1999 | Tan | 281/21.1 |
| 6,159,650 | A | | 12/2000 | Kai et al. | 430/139 |
| 6,164,451 | A | * | 12/2000 | Sherman | 206/581 |
| 6,164,859 | A | * | 12/2000 | Hambright | 402/73 |
| 6,186,690 | B1 | | 2/2001 | Duncan | 402/8 |
| 6,189,841 | B1 | | 2/2001 | LaPoint et al. | 248/99 |
| 6,238,828 | B1 | | 5/2001 | Kai et al. | 430/17 |
| 6,257,621 | B1 | | 7/2001 | Smith | 281/15.1 |
| D446,027 | S | | 8/2001 | LeFevre | D6/300 |
| 6,358,341 | B1 | | 3/2002 | Bergquist | 156/63 |
| 6,370,805 | B2 | | 4/2002 | Thompson | 40/778 |
| D460,482 | S | | 7/2002 | Nomura | D19/26 |
| 6,418,635 | B1 | | 7/2002 | Nelson et al. | 33/563 |
| 6,431,606 | B1 | | 8/2002 | Lowe et al. | 281/38 |
| 6,446,549 | B1 | | 9/2002 | Soucie et al. | 101/4 |
| 6,460,279 | B1 | | 10/2002 | Stanley et al. | 40/595 |
| 6,544,037 | B2 | | 4/2003 | Fink | 434/162 |
| 6,606,810 | B1 | | 8/2003 | Doucet | 40/711 |
| 6,607,215 | B2 | | 8/2003 | Nomura | 281/22 |
| 6,649,245 | B2 | | 11/2003 | Lenderink | 428/121 |
| 2004/0139643 | A1 | * | 7/2004 | Lee et al. | 40/771 |

* cited by examiner

*Primary Examiner*—Cassandra Davis
(74) *Attorney, Agent, or Firm*—Bateman IP Law Group

(57) ABSTRACT

A shadow box scrapbook page adapted to hold and secure three-dimensional objects for storage and display. The page includes a binder portion having openings to receive standard rings or posts common to binders, and a frame device, having a front, back and side, top and bottom sections, defining a cavity. The front is generally transparent for the viewing of the stored objects.

25 Claims, 5 Drawing Sheets

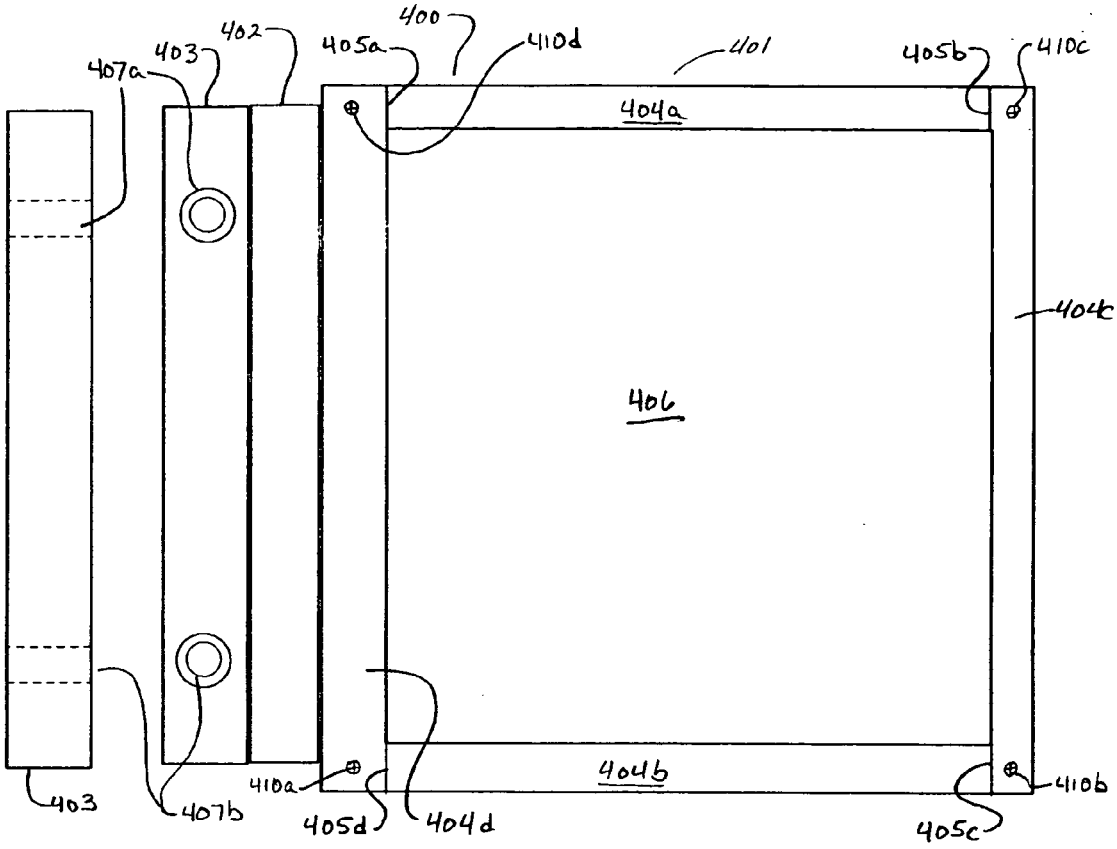
FIGURE 4B
FIGURE 4A
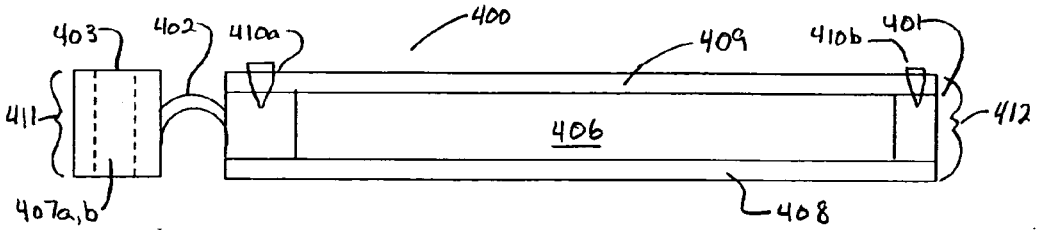
FIGURE 4C

SHADOW BOX PAGE

BACKGROUND OF THE INVENTION

1. Field of the Invention

This invention relates to devices for use in constructing scrap bock pages. More specifically, this invention relates to scrap book pages that are designed to hold three-dimensional objects in place within a frame.

2. Description of Related Art

A variety of devices are well known in the art for holding and/or preserving heirlooms, photographs and other objects in scrapbooks. Generally, these prior devices do not provide a mechanism for adequately holding and protecting three-dimensional objects within a frame while providing a mechanism for holding the framed objects within a book or binder for viewing and storage.

The reader is referred to the following U.S. patent documents for general background material. Each of these patents is hereby incorporated by reference in its entirety for the material contained therein.

U.S. Pat. No. 4,023,292 describes a binder loose leaf for mounting photographs or the like.

U.S. Pat. No. 5,118,171 describes a display case for mounting and attractively displaying an article of headgear along with memorabilia related to the headgear.

U.S. Pat. No. 5,349,769 describes an image presentation card comprising an image holder, constructed of a transparent sheet of polypropylene plastic.

U.S. Pat. No. 5,421,583 describes a form of print media product, which provides enhanced realism through a three-dimensional effect.

U.S. Pat. No. 5,575,503 describes a filing tool for filing one or more sheets provided with a magnetically attractable area on a side end or periphery of the sheet.

U.S. Pat. No. 5,754,713 describes an image-reading device provided with a case and a scanner.

U.S. Pat. No. Des. 398,916 describes a portion of a display panel with a surfing icon image.

U.S. Pat. No. 5,887,900 describes a scrapbook retainer system.

U.S. Pat. No. 5,947,522 describes a theme-based scrapbook that includes a plurality of folders bound between a front cover and a back cover.

U.S. Pat. No. 5,997,041 describes a photo album assembled with the minimum of machinery.

U.S. Pat. Nos. 6,159,650 and 6,238,828 B1 describe a printing method where a plurality of pieces of slip paper are bound into a book.

U.S. Pat. No. 6,186,690 B1 describes a strap connection system for releasably binding pages together within covers.

U.S. Pat. No. 6,189,841 B1 describes an insert apparatus for inserting items into pouches.

U.S. Pat. No. 6,257,621 B1 describes a kit and assembly for organizing, viewing and locating photographs, for example, on pages of a photo album or scrap book.

U.S. Pat. No. D446,027 S describes the ornamental design for a scrapbook page display device.

U.S. Pat. No. 6,358,341 B1 describes a method of making photo album templates.

U.S. Pat. No. 6,370,805 B2 describes a decorative mounting corner.

U.S. Pat. No. D460,482 S describes the ornamental design for the cover of a scrapbook.

U.S. Pat. No. 6,418,635 B1 describes a template for guiding an implement on a design page, such as a scrapbook page.

U.S. Pat. No. 6,431,606 B1 describes a memory album for retaining and displaying items of memorabilia.

U.S. Pat. No. 6,446,549 B1 describes a hand-held tool for embossing a sheet paper or other media.

U.S. Pat. No. 6,460,279 B1 describes a custom display storage system.

U.S. Pat. No. 6,544,037 B2 describes an apparatus for teaching and encouraging experiential writing by a child.

U.S. Pat. No. 6,606,810 B1 describes an apparatus or kit for creating a standard sized display.

U.S. Pat. No. 6,607,215 B2 describes a scrapbook that includes a spine adapted to bind a variable plurality of binder inserts.

U.S. Pat. No. 6,649,245 B2 describes a composition veneer that is extremely flexible, foldable and moldable, provided by impregnating a wood veneer with a plastic film.

SUMMARY OF THE INVENTION

It is desirable to provide a shadow box type scrapbook page that is adapted to securely hold three-dimensional objects in place for storage and viewing. It is particularly desirable to provide a shadow box type scrapbook page that is adapted to fit within a standard ring or post binder and which is designed to facilitate page turning by having a flexible hinge and a spacer having approximately the thickness of the page region.

Accordingly, it is an object of an embodiment of this invention to provide a scrapbook page designed to hold and display three-dimensional objects.

It is another object of an embodiment of this invention to provide a scrapbook page that has a framed page region.

It is a still further object of an embodiment of this invention to provide a scrapbook page that has a flexible hinge.

Another object of an embodiment of this invention is to provide a scrapbook page that has a binding post spacer region, having approximately the thickness of the framed page region.

A still further object of an embodiment of this invention is to provide a scrapbook page that includes a mounting back in a framed page region.

A further object of an embodiment of this invention is to provide a scrapbook page that includes a transparent cover.

Various embodiments of this invention may have one or more of the above objects of this invention. Additional objects, advantages and other novel features of this invention will be set forth in part in the description that follows and in part will become apparent to those skilled in the art upon examination of the following or may be learned with the practice of the invention. Some or all of the objects and advantages of this invention may be realized and attained by means of the instrumentalities and combinations particularly pointed out in the appended claims. Still other objects of the present invention will become readily apparent to those skilled in the art from the following description wherein there is shown and described various present preferred embodiments of the invention, simply by way of examples of illustrations of the modes presently known to the inventors to carry out this invention. As it will be realized, this invention is capable of other different embodiments, and its several details and specific components are capable of modification without departing from the concept of this invention. Accordingly, the objects, drawings and descriptions should be regarded as illustrative of various examples of this invention and not as restrictive of the scope of the claims.

BRIEF DESCRIPTION OF DRAWINGS

The accompanying drawings incorporated in and forming a part of the specification, illustrate various present embodiments or examples of the present invention. Some, although not all, alternative embodiments are described in the following description. In the drawings:

FIGS. 4*a*, 4*b* and 4*c* are a plan view, a side view and an end view of a second embodiment of the scrapbook page of this invention.

Reference will now be made in detail to the present preferred embodiment of the invention, examples of which are illustrated in the accompanying drawings.

DETAILED DESCRIPTION

This invention is a device, referred to herein as a shadow box page, adapted specifically for use in a binder or scrapbook, for holding and displaying three-dimensional objects. In its various embodiments, it provides a frame portion, a binder portion and a flex portion. The frame portion is used to hold and display the objects themselves and generally includes a peripheral frame, a back and a typically transparent front. The objects of interest are held fixed in some form to the back within the peripheral frame and under the transparent front for viewing. The binder portion includes the mechanism for connecting the device to a binder. Typically the binder portion is provided with two or more holes for receiving the posts or rings generally found as a part of a binder. In most embodiments, the binder portion is also designed with a thickness sufficient to align with the frame portion. The flex portion is the interface between the binder portion and the frame portion. This flex portion facilitates the turning of "pages" and provides strain and stress relief to the device as a whole when in use. At present, this device has been developed in several embodiments, each with various specific features. These embodiments are more fully described as follows in relation to the respective drawings.

Figure 1:
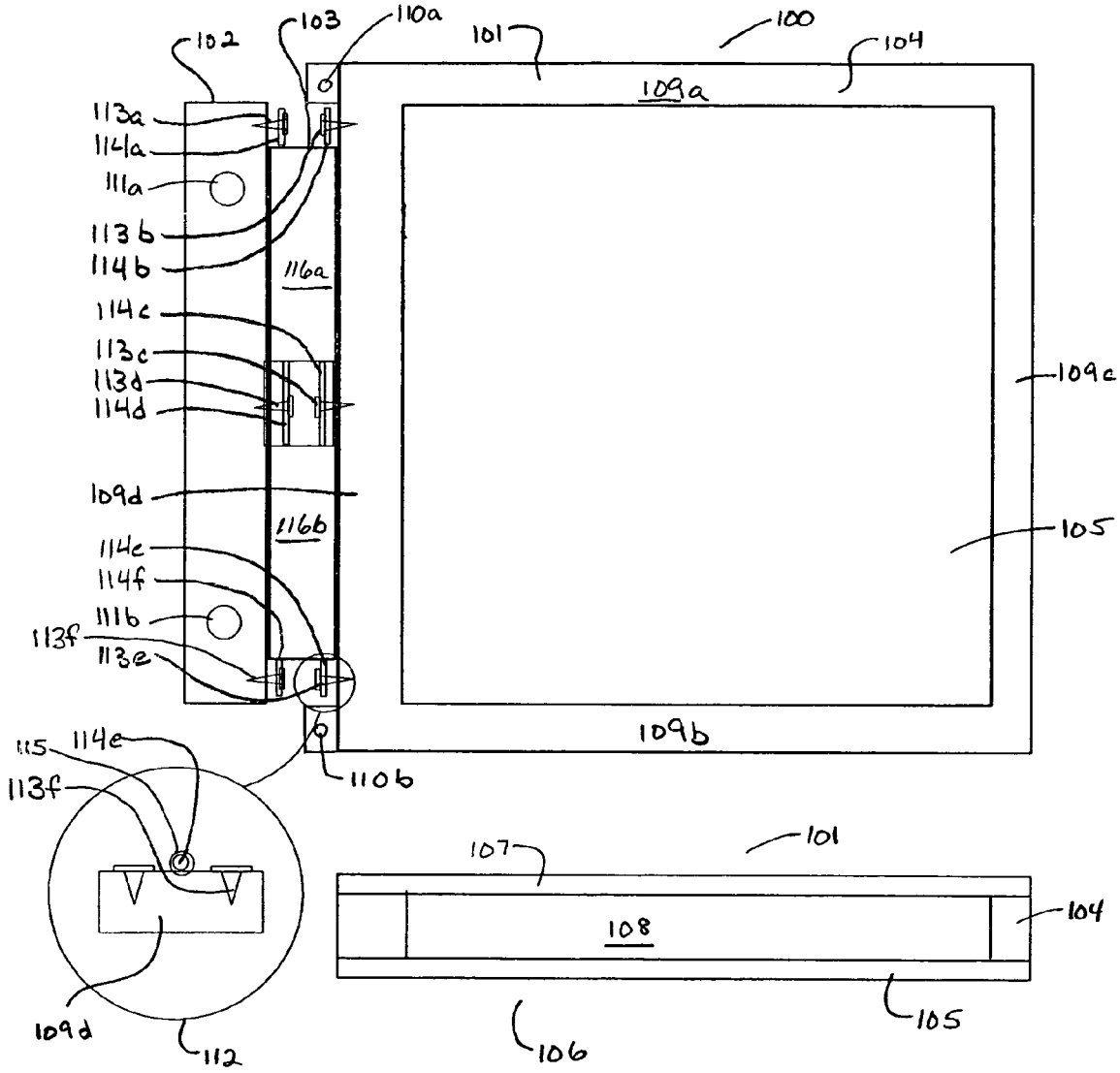
FIG. 1 is a plan view of a first embodiment of the scrapbook page of this invention.

Accordingly, FIG. 1 shows a plan view of a first embodiment of the scrapbook page of this invention. The shadow box page 100 has a frame portion 101, a binder portion 102 and a flex portion 103. The frame portion 101 has frame 104 generally located about the periphery of a back 105. The frame 104 is mounted to the back 105 using adhesive glue, although nails, screws, bolts and nuts and pins could be substituted without departing from the concept of this invention. The frame 104 and the back 105 are composed of wood in the present embodiment, although in alternative embodiments either or both could be made of metal, plastic or combination or composite material without departing from the concept of this invention. An edge view 106 of the frame is provided to show the three-dimensional structure of the shadow box page 100. This edge view 106 shows more clearly the transparent front 107, typically glass or plastic or the like, mounted to the frame 104, which in turn is mounted to the back 105. The combination defines a space 108 adequate for holding and displaying three-dimensional objects. In this embodiment of the frame portion 101, the frame 104 is composed of four sections: the top 109*a*, bottom 109*b*, right side 109*c*, and left side 109*d*, joined together at the corners presently using adhesive, screws, nails, bolts/nuts and the like. In this present embodiment, the top 109*a*, bottom 109*b* and right side 109*c* are approximately 12 inches in length, 0.25 inch in thickness; the left side 109*d* is approximately 12 inches in length and 0.50 inches in thickness. The height of the sides 109*a,b,c,d* can be selected, presently amount 0.50 inch; 0.75 inch; 1 inch; 1.25 inches and 1.5 inches, depending on the desired space 108. In alternative embodiments of the shadow box page, a wide range of dimensions can be substituted without departing from the concept of this invention, as is desirable to be functional in a selected binder. One or more page alignment holes 110*a,b* can be provided to aid in the alignment of shadow box pages. The binder portion 102 is provided with two or more ring/pin holes 111*a,b* positioned to match up with standard rings/pins of a binder. The present binder portion 102 is made of wood, plastic, metal or other composite or combination material and is presently 12 inches in length and 0.5 inch in width. The height of the binder portion 102 is preferably selected to match the combined height of the frame portions 109*a,b,c,d* added to the height of the transparent front 107 (typically 0.125 inch) and the back 105 (typically 0.125 inch). The flex portion 103 is attached to both the frame portion 101 and the binder portion 102. This attachment is presently made as shown in insert 112. In this embodiment, the each attachment point includes a rod 114*a-f* within a sleeve 115 held in place by a pair of screws 113*a-f*, providing a pivot about the rod 114. In this embodiment the flexible portion is provided by the combination of the attachment points 112 and two sections 116*a,b,* composed of flexible cloth, mesh or synthetic material.

Figure 2A:
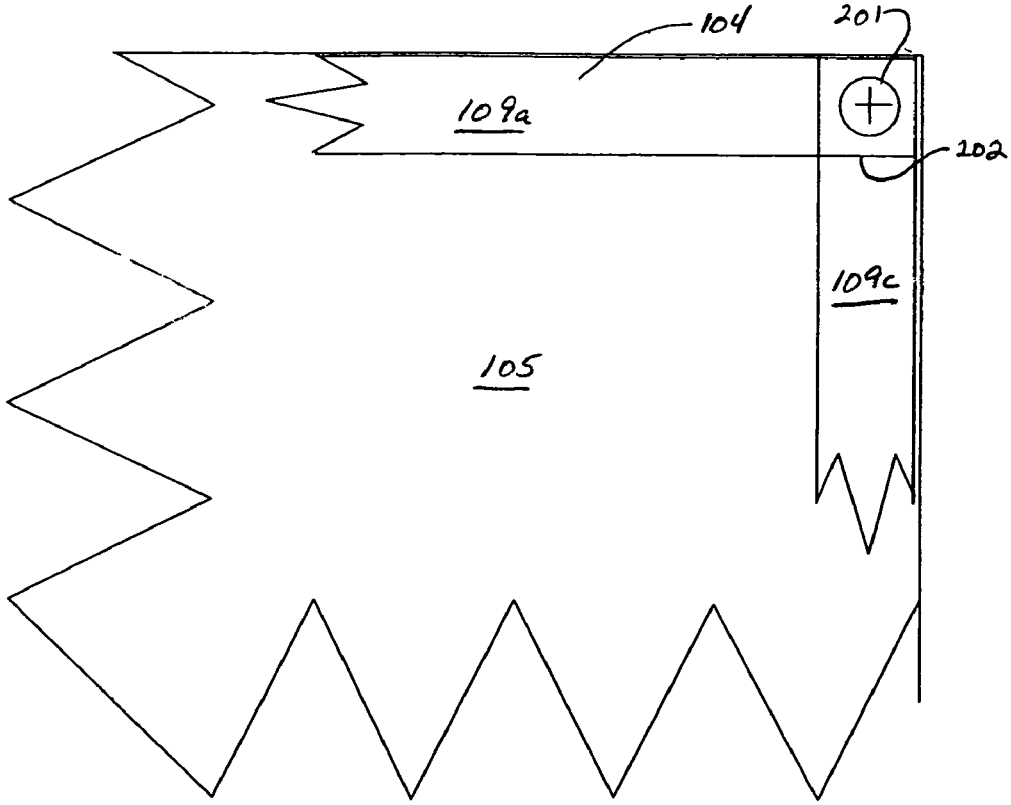
FIGS. 2*a* and 2*b* are detailed drawings of the corner assembly of the first embodiment of the scrapbook page of this invention.
Figure 2B:
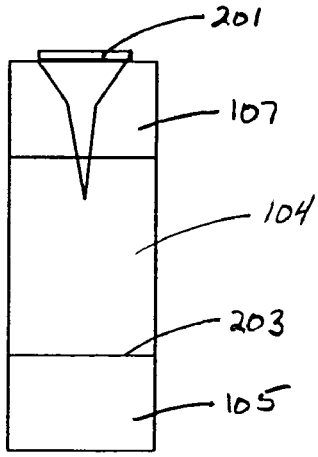

FIGS. 2*a* and 2*b* show detailed drawings of the corner assembly of the first embodiment of the scrapbook page of this invention. In FIG. 2*b*, a screw 201 is provided to fasten the transparent front 107 to the frame 104 of the frame portion 101. The frame 104 is shown secured to the back 105 by adhesive positioned at the joint 203. An adhesive is used in the this embodiment at the joint 202 between the right side 109*c* and the top 109*a* of the frame 104 to fasten the top 109*a* to the right side 109*c* of the frame. A similar corner assembly, with a screw to hold the transparent front 107 to the frame and adhesive to fix the sides 109*c*, 109*d* to the top 109*a* and bottom 109*b* respectively can be used for the other corners of the frame 101.

Figure 3A:
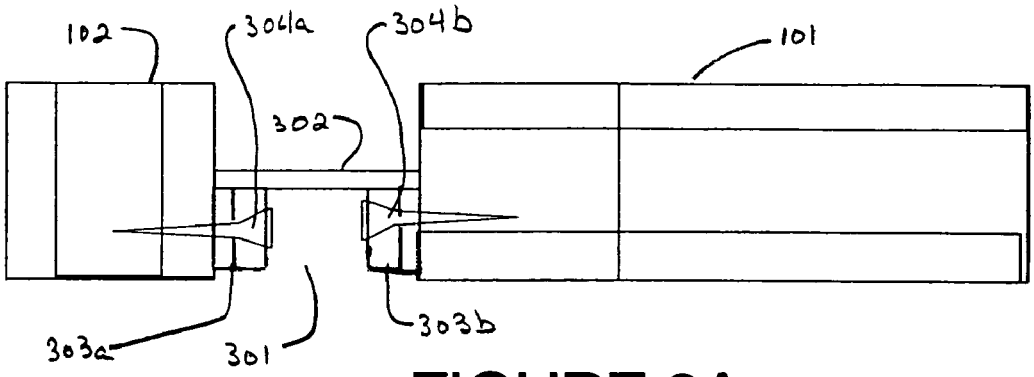
FIGS. 3*a*, 3*b* and 3*c* are detailed drawings of the attachment of the hinge device used in the first embodiment of this invention.
Figure 3B:
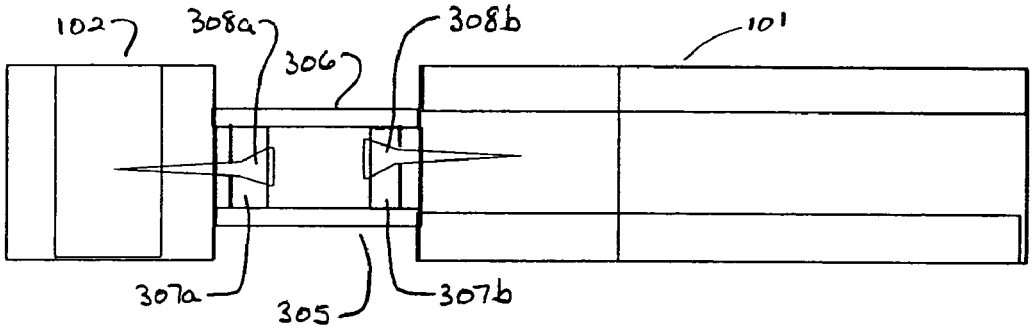
Figure 3C:
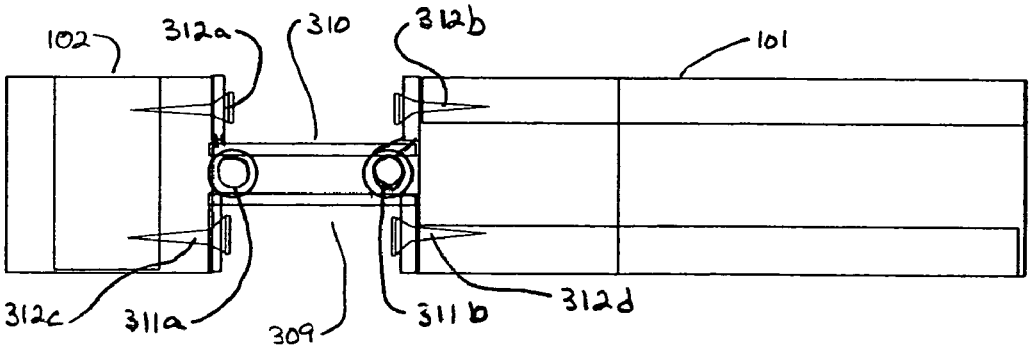

FIGS. 3*a*, 3*b* and 3*c* are detailed drawings of the attachment of the hinge device used in the first embodiment of this invention. FIG. 3*a* shows a first hinge fastener 301 connecting the binder portion 102 to the frame portion 101. This fastener 301 includes a flexible hinge 302 attached at its ends to two seating blocks 303*a,b*. The seating blocks 303*a,b* (and the attached ends of the flexible hinge 302) are fixed to the binder portion 102, by screw 304*a*, and to the frame portion 101, by screw 304*b*. The flexible hinge 302 in this embodiment is made of fabric, although alternatively it can be made of a metal mesh, a flexible synthetic material or the like.

FIG. 3*b* shows a second hinge fastener 305 connecting the binder portion 102 to the frame portion 101. This fastener 305 includes a flexible hinge 306 attached by being wrapped about two seating blocks 307*a,b*. The seating blocks 307*a,b* (and the flexible hinge 306) are fixed to the binder portion 102, by screw 308*a*, and to the frame portion 101, by screw 308*b*. Again, the flexible hinge 306 in this embodiment is made of fabric, although alternatively it can be made of a metal mesh, a flexible synthetic material or the like.

FIG. 3*c* shows a third hinge fastener 309 connecting the binder portion 102 to the frame portion 101. This fastener 309 includes a flexible hinge 310 attached by wrapping about to two hinge pins 311*a,b*. The hinge pins 311*a,b* include a pin within a sleeve, the sleeve having ends for attachment to the binder portion 102 and the frame portion 101. The attachment of the sleeve ends of the first hinge pin 311*a* to the binder portion 102 are made by a pair of screws 312*a,c*, while the attachment of the sleeve ends of the second hinge pin 311*b* to the frame portion 101 are made by a pair of screws 312*b,d*. Again, the flexible hinge 302 in this embodiment is made of fabric, although alternatively it can be made of a metal mesh, a flexible synthetic material or the like.

FIGS. 4*a*, 4*b* and 4*c* are a plan view, a side view and an end view of a second embodiment of the scrapbook page of this invention. In this embodiment or example of the invention 400, as shown in FIG. 4*a*, a frame portion 401 is attached to a flexible hinge portion 402, which in turn is attached to the binder portion 403. The frame portion 401 is composed of a top section 404*a*, a bottom section 404*b*, a right section 404*c* and a left section 404*d*. The top section 404*a* is attached to a right side section 404*c* at joint 405*b*, typically by an adhesive, although alternatively the sections can be fixed using screws, staples, nails and the like. The top section 404*a* is attached to the left side section 404*d* at joint 405*a*, again typically by an adhesive, although alternatively the sections can be fixed using screws, staples, nails and the like. The bottom section 404*b* is attached to a right side section 404*c* at joint 405*c*, typically by an adhesive, although alternatively the sections can be fixed using screws, staples, nails and the like. The bottom section 404*b* is attached to the left side section 404*d* at joint 405*d*, again typically by an adhesive, although alternatively the sections can be fixed using screws, staples, nails and the like. This construction of frame sections 404*a,b,c,d*, in combination with the back 408 and the transparent front 409 define a cavity 406 for holding and displaying three dimensional objects, as is shown in an alternative view in FIG. 4*c*. The transparent front 409 is typically made of glass or transparent plastic or the like. In the present embodiment, 400 this transparent front is held to the frame section corners 411*a, b,c,d* by screws 410*a,b,c,d*. In this embodiment, the frame sections 404*a,b,c,d* are made of wood, although alternatively plastic, metal, composite, and/or composition materials can be substituted without departing from the concept of this invention. The flexible hinge portion 402 is typically attached to the frame portion 401 by adhesive, staples, screws, nails, bolts/nuts and the like. The flexible hinge portion 402 in this embodiment is made of a flexible cloth or cloth-like material. The flexible hinge 402 is attached to the binder portion 403 by adhesive, staples, screws, nails, bolts/nuts and the like. The binder portion 403 is designed to have approximately the same thickness 411 as that of the thickness 412 assembled frame portion 401.

Figure 5A:
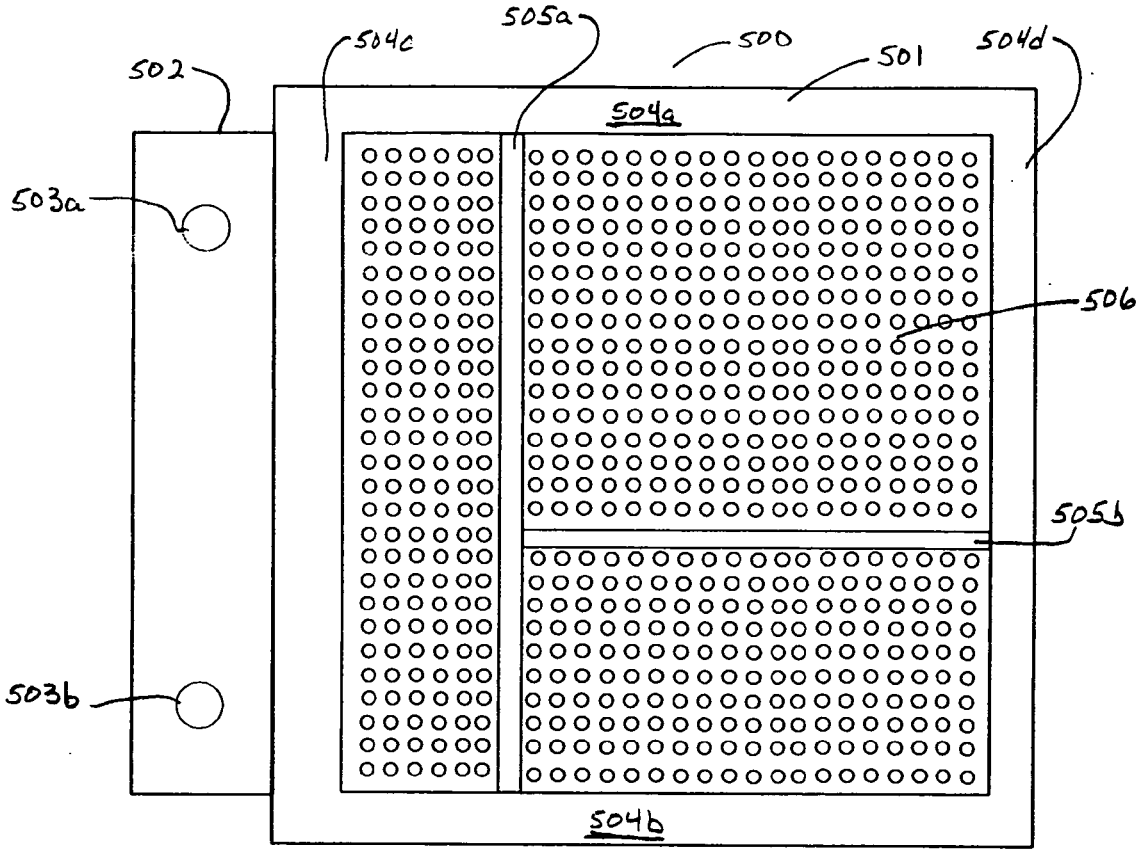
FIGS. 5*a* and 5*b* are plan and side views of a third embodiment of the scrapbook page of this invention.
Figure 5B:
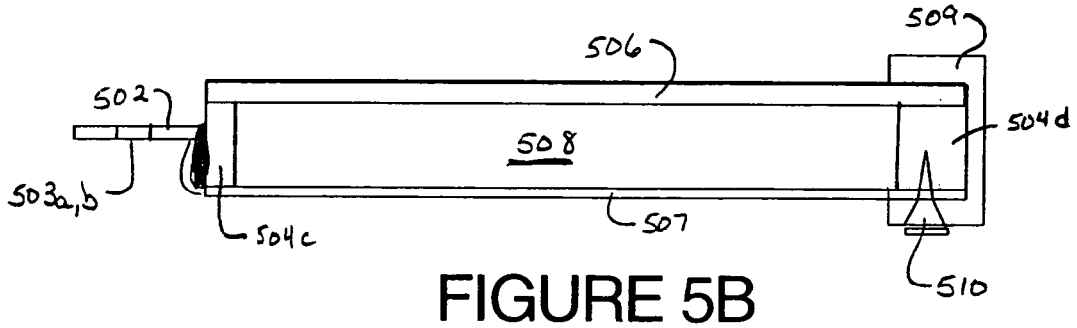

FIGS. 5*a* and 5*b* are plan and side views of a third embodiment of the scrapbook page of this invention. As shown in FIGS. 5*a* and 5*b*, the frame portion 501 is fixed to a binder portion 502. The binder portion 502 is provided with a plurality of holes 503*a,b* for receiving binder rings and/or posts. FIG. 5*a* shows that the frame portion 501 is made of four sections, a top 504*a*, bottom 504*b*, left side 504*c* and right side 504*d*, typically held together with adhesive, screws, bolt/nuts, nails and/or pins and the like. In an alternative embodiment, the entire frame 501 is made as one part. The frame sections 504*a,b,c,d* are typically made of wood, plastic, metal, composite and/or composition materials. This embodiment includes one or more dividers 505*a,b* that are used to subdivide the storage/display cavity 508. Also, the back 507 of this embodiment is provided with a plurality of holes 506, which are provided to facilitate the tying of objects in place within the storage/display cavity 508. FIG. 5*b* shows a side section view showing the assembly held in place with a clamp 509 holding the transparent front 506 to the frame sides 504*a,b,c,d*. The clamp 509 is held in place with a setscrew 510. The back 507 extends behind the left side 504*c* of the frame to become (or hold in place) the binder portion 502.

The foregoing description of the present embodiments of the invention has been presented for the purposes of illustration and description of the best mode of the invention currently known to the inventors. It is not intended to be exhaustive or to limit the invention to the precise form disclosed. Obvious modifications or variations are possible and foreseeable in light of the above teachings. This embodiment of the invention was chosen and described to provide the best illustration of the principles of the invention and its practical application to thereby enable one of ordinary skill in the art to utilize the invention in various embodiments and with various modifications as are suited to the particular use contemplated. All such modifications and variations are within the scope of the invention as determined by the appended claims when they are interpreted in accordance with the breadth to which they are fairly, legally and equitably entitled.

The invention claimed is:

1. A shadow box page device comprising:

(A) a frame portion, wherein said frame portion comprises a frame defining a generally enclosed cavity for holding one or more three dimensional objects, the frame extending generally around the periphery of the cavity so as to be disposed on each side of the cavity, a back configured for use in mounting said one or more three dimensional objects, and an at least partially transparent front;

(B) a flex hinge portion attached to said frame portion; and (C) a binder portion attached to said flex hinge portion, wherein said binder portion has a thickness essentially the same as a thickness of said frame portion.

2. A shadow box page device comprising:

(A) a frame portion:

(B) a flex hinge portion attached to said frame portion, wherein said flex hinge portion further comprises: a flexible hinge and a hinge fastener, wherein said hinge fastener further comprises a plurality of fasteners and a plurality of hinge blocks; and (C) a binder portion attached to said flex hinge portion.

3. A shadow box page device comprising:

(A) a frame portion:

(B) a flex hinge portion attached to said frame portion, wherein said flex hinge portion further comprises: a flexible hinge and a hinge fastener, wherein said hinge fastener further comprises a plurality of post and sleeve devices held in place to said frame portion by a plurality of fasteners; and (C) a binder portion attached to said flex hinge portion.

4. A shadow box page device comprising:

(A) a frame portion;

(B) a binder portion; and (C) a flex hinge portion attached to said frame portion and attached to said binder portion, wherein said flex hinge portion further comprises: a flexible hinge and a hinge fastener, wherein said hinge fastener further comprises a plurality of post and sleeve devices held in place to said binder portion by a plurality of fasteners.

5. A shadow box page device comprising:

(A) a frame portion, defining a generally enclosed cavity for receiving three-dimensional objects for storage and display, the frame portion compromising a frame extending around the periphery of the cavity, the frame having a first side and a second side, a back attached to the first side of the frame, and a front attached to the second side of the frame, wherein at least one of the front and the back are removable from the frame;

(B) a flex hinge portion attached to said frame portion; and (C) a binder portion attached to said flex hinge portion, wherein said binder portion has a thickness generally equal to a thickness of said frame portion.

6. A shadow box page device comprising:

(A) a frame portion, defining a cavity for holding and displaying one or more three dimensional objects, wherein said frame portion further comprises a plurality of frame sections, a back having a plurality of holes for mounting one or more three dimensional objects, and an at least partially transparent front, and wherein said frame portion is held together by a clamp and screw device; and (B) a binder portion.

7. A shadow box page device, as recited in claim 6, wherein said binder portion is attached to said frame portion by a flexible hinge.

8. A shadow box page device, as recited in claim 6, wherein said back extends to hold said binder portion to said frame portion.

9. A shadow box page device, as recited in claim 6, wherein said back extends to be said binder portion.

10. A shadow box page device comprising:

(A) a frame portion defining a cavity for holding and displaying one or more three dimensional objects, the frame portion comprising a back portion, the back portion further comprising mounting structures configured for mounting one or more three-dimensional objects for storage and display;

(B) a binder portion; and further comprising one or more dividers within said frame portion for dividing said cavity into two or more sub-cavities, and further comprising a flexible hinge portion connecting the frame portion to the binder portion.

11. A shadow box page device comprising:

(A) a frame portion defining a cavity for holding and displaying one or more three dimensional objects, the frame portion comprising:

a back;

a plurality of sides attached to the back; and an at least partially transparent front removably attached to the plurality of sides, wherein the at least partially transparent front is removably attached to the plurality of sides by screws; and (B) a binder portion attached to the frame portion configured for mounting the shadow box page device into a binder.

12. The shadow box page device of claim 11, wherein the binder portion is about as thick as the frame portion.

13. A shadow box page device comprising:

(A) a frame portion defining a cavity for holding and displaying one or more three dimensional objects, the frame portion comprising:

a back;

a plurality of sides attached to the back; and an at least partially transparent front removably attached to the plurality of sides;

(B) a binder portion attached to the frame portion configured for mounting the shadow box page device into a binder; and wherein the binder portion is substantially the same thickness as the frame portion.

14. A shadow box page device comprising:

(A) a frame portion defining a cavity for holding and displaying one or more three dimensional objects, the frame portion comprising:

a back;

a plurality of sides attached to the back; and an at least partially transparent front removably attached to the plurality of sides;

(B) a binder portion attached to the frame portion configured for mounting the shadow box page device into a binder; and wherein the binder portion is attached to the frame potion via a flexible hinge.

15. A shadow box page device comprising:

(A) a frame portion defining a cavity for holding and displaying one or more three dimensional objects, the frame portion comprising:

a back;

a plurality of sides attached to the back; and an at least partially transparent front attached to the sides;

(B) a binder portion attached to the frame portion, the binder portion comprising a plurality of openings formed therein for attaching the shadow box page device into a binder, and wherein the binder portion is about as thick as the frame portion.

16. The shadow box page device of claim 15, wherein the binder portion is the same thickness as the frame portion.

17. The shadow box page device of claim 15, wherein each of the plurality of openings comprises a continuous channel through the binder portion.

18. The shadow box page device of claim 15, wherein the binder portion is attached to the frame portion by a flexible hinge.

19. The shadow box page device of claim 15, wherein the back further comprises a plurality of mounting structures for mounting one or more three dimensional objects.

20. A shadow box page device comprising:

(A) a frame portion defining a cavity for holding and displaying one or more three dimensional objects, the frame portion comprising:

a back;

a frame extending forwardly from the back so as to form the cavity; and an at least partially transparent front attached to the frame;

(B) a binder portion attached to the frame portion, the binder portion comprising a plurality of openings formed therethrough for attaching the shadow box page device into a binder, and wherein the binder portion is about as thick as the frame.

21. The shadow box page device of claim 20, wherein the frame portion is between about 0.5 inch and about 1.5 inch in thickness.

22. The shadow box page device of claim 20, wherein the front is attached to the frame with screws.

23. The shadow box page device of claim 20, wherein the plurality of openings form uninterrupted conduits through the binder portion.

24. The shadow box page device of claim 20, wherein the binder portion is attached to the frame portion via a flexible hinge.

25. The shadow box page device of claim 20, wherein the binder portion is removably attached to the frame portion.

* * * * *

UNITED STATES PATENT AND TRADEMARK OFFICE

CERTIFICATE OF CORRECTION

PATENT NO. : 7,305,785 B2
APPLICATION NO. : 10/773056
DATED : December 11, 2007
INVENTOR(S) : David R. Sharp It is certified that error appears in the above-identified patent and that said Letters Patent is hereby corrected as shown below:

Column 1:
Line 7, it reads “scrap bock pages.”; should read “scrap book pages.”

Signed and Sealed this

Seventeenth Day of February, 2009

JOHN DOLL
*Acting Director of the United States Patent and Trademark Office*